US005081009A

United States Patent [19]

Tanemura et al.

[11] Patent Number: 5,081,009

[45] Date of Patent: Jan. 14, 1992

[54] PROCESS FOR PREPARING AN INTERNAL LATENT IMAGE SILVER HALIDE EMULSION

[75] Inventors: Hatsumi Tanemura; Sadanobu Shuto; Noriyuki Inoue; Naoyasu Deguchi, all of Kanagawa, Japan

[73] Assignee: Fuji Photo Film Co., Ltd., Kanagawa, Japan

[21] Appl. No.: 559,452

[22] Filed: Jul. 25, 1990

Related U.S. Application Data

[62] Division of Ser. No. 304,456, Feb. 1, 1989, abandoned.

[30] Foreign Application Priority Data

Feb. 1, 1988 [JP] Japan ..... 63-21809
Apr. 5, 1988 [JP] Japan ..... 63-83677

[51] Int. Cl.[5] ..... G03C 1/035; G03C 1/09

[52] U.S. Cl. ..... 430/569; 430/603; 430/611; 430/614; 430/567

[58] Field of Search ..... 430/547, 569, 567, 603, 430/611, 614

[56] References Cited

U.S. PATENT DOCUMENTS

| | | | |
|---|---|---|---|
| 2,394,198 | 2/1946 | Mueller | 430/607 |
| 3,047,393 | 7/1962 | Herz et al. | 430/607 |
| 3,311,474 | 3/1967 | Willems et al. | 430/611 |
| 4,198,240 | 4/1980 | Mikawa | 430/570 |
| 4,263,396 | 4/1981 | Klotzer et al. | 430/409 |
| 4,276,374 | 6/1981 | Mifune et al. | 430/611 |
| 4,726,451 | 1/1988 | Shuto et al. | 430/379 |
| 4,789,627 | 12/1988 | Inoue et al. | 430/406 |
| 4,863,845 | 9/1989 | Murai et al. | 430/569 |
| 4,912,026 | 3/1990 | Miyoshi et al. | 430/546 |
| 4,960,689 | 10/1990 | Nishikawa et al. | 430/603 |

FOREIGN PATENT DOCUMENTS 249239 12/1987 European Pat. Off. .

*Primary Examiner*—Charles L. Bowers, Jr.

*Assistant Examiner*—Janet C. Baxter

*Attorney, Agent, or Firm*—Sughrue, Mion, Zinn Macpeak & Seas

[57] ABSTRACT

A direct positive photosensitive material composed of a support having thereon at least one photosensitive emulsion layer comprising non-prefogged internal latent image silver halide grains and at least one compound represented by formulae (I), (II), (III) or (IV):

(I)

wherein $M_1$ represents hydrogen, a cation or a protective group capable of being cleaved by an alkali; and Z represents an atomic group necessary for forming a 5-membered or 6-membered substituted or unsubstituted ring selected from a heterocyclic ring and a condensed heterocyclic ring;

$$Z-SO_2-S-M \quad \text{(II)}$$

(III)

(IV)

wherein $Z_1$ represents an alkyl group containing from 1 to 18 carbon atoms, an aryl group containing from 6 to 18 carbon atoms or a heterocyclic group; $Y_1$ and $Y_2$, which may be the same or different, each represents an atomic group necessary for forming an aromatic ring containing from 6 to 18 carbon atoms or a heterocyclic ring; M represents a metal atom or an organic cation; and n is an integer of 2 to 10.

13 Claims, No Drawings

PROCESS FOR PREPARING AN INTERNAL LATENT IMAGE SILVER HALIDE EMULSION

This is a divisional of application Ser. No. 07/304,456, filed Feb. 1, 1989, now abandoned.

FIELD OF THE INVENTION

This invention relates to a direct positive photographic material, and more particularly, to a direct positive photographic material which is excellent in image - identifiability.

BACKGROUND OF THE INVENTION

There are well known photographic processes for obtaining direct positive images without requiring a reversal processing step or a negative film.

The processes for preparing positive images using conventional silver halide direct positive photographic materials can be chiefly classified into the following two groups from the viewpoint of practical usefulness, except for certain special processes.

The first type is a process using a pre-fogged silver halide emulsion, in which a direct positive image is obtained after development by breaking fog nuclei (latent image) in exposed areas utilizing solarization or the Herschel effect.

The second type is a process using an internal latent image silver halide photographic emulsion which is not previously fogged, in which a direct positive image is obtained by conducting surface development either after fogging processing or while carrying out fogging processing after image exposure.

The term "internal latent image silver halide photographic emulsion" as used herein means a silver halide photographic emulsion which has sensitivity specks chiefly in the interior of silver halide grains, and a latent image is formed chiefly in the interior of the grains by exposure.

Known methods for selectively forming fog nucleui (a latent image) as described above, include a method generally called a "light fogging method", in which a second exposure is given to the whole surface of a sensitive layer (described in, for example, U.K. Patent 1,151,363) and a method called a "chemical fogging method", in which a nucleating agent is used. These methods are described in, for example, *Research Disclosure,* Vol. 151, No. 15162, pages 76–78 (November 1976).

The chemical fogging process has generally higher sensitivity than the light fogging process, so that the chemical fogging process is suitable for use in fields which require high sensitivity. The present invention relates to a chemical fogging process.

Various techniques in this field are known and described in U.S. Pat. Nos. 2,592,250, 2,466,957, 2,497,875, 2,588,892, 3,317,322, 3,761,266, 3,761,276 and 3,796,577 and U.K. Patents 1,151,363, 1,150,553 and 1,011,062.

Photographic materials having relatively high sensitivity as direct positive materials can be prepared by using these known processes.

The mechanism of forming a direct positive image is described in more detail in James, *The Theory of the Photographic Process,* (4th ed), Chapter 7, pages 182–193 and U.S. Pat. No. 3,761,276.

Without being limited by theory, it is believed that fog nucleui are selectively formed on the surfaces of silver halide grains in unexposed areas by a surface desensitizing action due to the internal latent image formed in the interior of silver halide grains by first imagewise exposure. A direct positive image is then formed in the unexposed areas by carrying out a surface development treatment.

In forming direct positive images by using the light fogging method or chemical fogging method, the development rate is low and processing time is long as compared with conventional negative materials, although processing time has been shortened by increasing the pH value of the developing solution and/or elevating the temperature thereof. However, when the pH value or the temperature is high, the minimum image density of the resulting direct positive image is generally increased. Further, the developing solution is liable to be deteriorated by air oxidation, when the developing solution is used under high pH conditions. As a result, developing activity is greatly lowered.

As methods for increasing the maximum density of the direct positive image while keeping a low minimum density, there are known a method using hydroquinone derivatives (U.S. Pat. No. 3,227,522) and a method using mercapto compounds having a carboxyl group or sulfo group disclosed in JP-A-60-170843 (the term "JP-A" as used herein means an "unexamined published Japanese patent application"). However, the effects obtained by using these compounds are insufficient. An effective method has not been found which can increase the maximum density of a direct positive image without increasing the minimum density thereof. A method is desired which gives a sufficient maximum image density, even when a developing solution having a low pH is used.

In the formation of direct positive images by the light fogging method or the chemical fogging method, there is a problem that gradation is soft. This tendency is particularly remarkable in highlight areas. Thus, images formed by these methods have the disadvantage that tone is liable to be insufficiently reproduced.

As methods for obtaining a photographic material for forming higher contrast direct positive images to solve this problem, there are known a method using a monodisperse system of silver halide grains; a method in which silver halide grains are doped with a polyvalent metal ion (U.S. Pat. Nos. 3,367,778 and 3,287,136); and a method in which a core/shell type emulsion is used and the sensitization of the core part is adjusted (U.S. Pat. No. 4,035,185). However, the effects obtained by these methods are insufficient.

Further, a method using mercapto compounds having a carboxyl or sulfo group (JP-A-60-170843) is known. However, the effects obtained by using these compounds are insufficient, and no conventional method is capable of effectively raising the maximum density of a direct positive image without causing an increase in the minimum density thereof. A method is desired, for obtaining a sufficient maximum image density, even when a developing solution having a low pH is used in particular.

SUMMARY OF THE INVENTION

Accordingly, an object of the present invention is to provide a direct positive photographic material, which gives a direct positive image having a low minimum image density and a high maximum image density.

Another object of the present invention is to provide a direct positive photographic material, which gives a direct positive image having both a low minimum image density and a high maximum image density by quick processing.

A further object of the present invention is to provide a direct positive photographic material, which gives a high-contrast positive image.

It has now been found that these and other objects of the present invention are achieved by a direct positive photosensitive material, composed of a support having thereon at least one photosensitive emulsion layer containing non-prefogged internal latent image silver halide grains and at least one compound represented by formulae (I), (II), (III) or (IV):

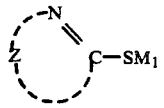

(I)

wherein $M_1$ represents hydrogen, a cation or a protective group, capable of being cleared by an alkali; and Z represents an atomic group necessary for forming a five-membered or six-membered substituted or unsubsidized ring selected from a heterocylic ring and a condensed heterocylic ring;

$$Z_1-SO_2-SM \quad \text{(II)}$$

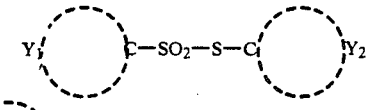

(III)

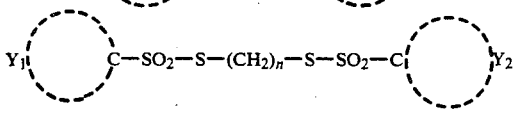

(IV)

wherein $Z_1$, represents an alkyl group containing from 1 to 18 carbon atoms, an aryl group containing from 6 to 18 carbon atoms or a heterocyclic group; $Y_1$ and $Y_2$, which may be the same of different, each represents an atomic group necessary for forming an aromatic ring containing from 6 to 18 carbon atoms or a heterocyclic ring; M represents a metal atom or an organic cation; and n is an integer of 2 to 10.

DETAILED DESCRIPTION OF THE INVENTION

In formulae (II), (III) and (IV), the alkyl group, the aryl group, the heterocyclic group, the aromatic ring and the heterocyclic ring represented by $Z_1$, $Y_1$ and $Y_2$ may be substituted.

The non-prefogged internal latent image type silver halide grains, which can be used in the present invention, are now described in greater detail. It is preferred that the grains have a core/shell structure.

The core grains may be formed by a conversion process. At least one conventional chemical sensitization such as gold sensitization, sulfur sensitization, reduction sensitization or the like may be used, or such chemical sensitization may be omitted. The core grains may be doped with a metal such as iridium, palladium or rhodium.

The shell may be chemically sensitized or unsensitized. However, it is preferred that the shell is chemically sensitized.

The "non-prefogged internal latent image silver halide emulsion", which is used in the present invention, is an emulsion containing silver halide in which the surfaces of silver halide grains are not previously fogged and a latent image is predominantly formed in the interior of the grains. More specifically, the term refers to a silver halide emulsion in which the maximum density obtained by using the following developing solution A (internal developing solution) is preferably at least 5 times, more preferably at least 10 times the maximum density obtained by using the following developing solution B (surface developing solution). The maximum density obtained by using following developing solution A is determined in the following manner: a transparent support is coated with the silver halide emulsion in an amount of 0.5 to 3 g/m$^2$ (in terms of silver), the coated material is exposed for a fixed period of 0.01 to 10 seconds, the exposed material is developed at 18° C. for 5 minutes by using the following developing solution A (internal developing solution) and the maximum density of the developed material is measured by conventional photographic density - measuring method. The maximum density obtained by using developing solution B is obtained in the following manner: the support is coated with the same silver halide emulsion in the same amount, exposure is conducted in the same manner, the exposed material is developed at 20° C. for 6 minutes by using the following developing solution B (surface developing solution) and the maximum density is measured.

| | |
|---|---|
| Surface developing solution B | |
| Metol | 2.5 g |
| L-Ascorbic acid | 10 g |
| $MaBO_2.4H_2O$ | 35 g |
| KBr | 1 g |
| Water | makes 1 l |
| Internal developing solution A | |
| Metol | 2 g |
| Sodium sulfite (anhydrous) | 90 g |
| Hydroquinone | 8 g |
| Sodium carbonate (monohydrate) | 52.5 g |
| KBr | 5 g |
| KI | 0.5 g |
| Water | makes 1 l |

Examples of the internal latent image type emulsions include conversion type silver halide emulsions disclosed in U.K. Patent 1,011,062 and U.S. Pat. Nos. 2,592,250 and 2,456,943 and core/shell type silver halide emulsions. Examples of the core/shell type silver halide emulsions include emulsions disclosed in JP-A-47-32813, JP-A-47-32814, JP-A-52-134721, JP-A-53-60222, JP-A-53-66218, JP-A-53-66727, JP-A-57-136641, JP-A-58-70221, JP-A-59-208540, JP-A-59-216136, JP-A-60-107641, JP-A-60-247237, JP-A-61-2148 and JP-A-61-3137, JP-B-56-18939 (the term "JP-B" as used herein means an "examined Japanese patent publication"), JP-B-58-1412, JP-B-58-1415, JP-B-58-6935 and JP-B-58-108528, JP-A-62-194248, U.S. Pat. Nos. 3,206,313, 3,317,322, 3,761,266, 3,761,276, 3,850,637, 3,923,513, 4,035,185, 4,395,478, 4,431,730 and 4,504,570, European Patent 0017148 and *Research Disclosure* Nos. *RD* 16345 (November 1977), *RD* 18155 (May 1979) and *RD* 23510 (November 1983).

There is no specific limitation with regard to the composition of the silver halide used. Any of silver bromide, silver iodobromide, silver chloride, silver chlorobromide and silver chloroiodiobromide can be sued. The core and the shell may have the same halogen composition or different halogen compositions from each other.

It is preferred that the silver halide to be used in the present invention contains no silver iodide. Even when silver iodide is incorporated therein, the amount of silver iodide is preferably not more than 10 mol %. Silver chlorobromide containing less than 50 mol% of Cl is also preferred and particularly exclusive use of silver bromide is the most preferred.

The mean grain size (represented by the diameter of a sphere of the same volume as the grain) of the silver halide grains is preferably at most 2.0 μm, and at least 0.2 μm, more preferably at most 1.2 μm, and at least 0.4 μm. Though the grain size distribution may be narrow or wide, it is preferred to use a monodisperse silver halide emulsion having a narrow grain size distribution in the present invention to improve graininess or sharpness.

The term "monodisperse silver halide emulsion" as used herein refers to emulsions having a grain size distribution defined by the following formula. Such emulsions have a coefficient of variation of at most 20, this value being obtained by dividing the standard deviation S of the grain size distribution by the mean grain size F, where:

$$S = \frac{\sqrt{\Sigma(r - r_i)^2 n_i^2}}{\Sigma n_i} \quad \frac{S}{r} \leqq 0.20$$

The mean grain size is the mean value of diameters when spherical silver halide grains are used. When the grains are in the form of a cube or other shape, the mean grain size is the mean value of diameter of a circle having the same area as the projected area of the grains. The mean grain size F is defined by the following formula:

$$F = \frac{\Sigma n_i r_i}{\Sigma n_i}$$

wherein $r_i$ is the grain size of individual grain and $n_i$ is the number of the grains.

The above grain size can be measured by any conventional method which are known by those skilled in the art. Typical methods are described in Loveland, "Grain size Analytical Method" *A.S.T.M. Symposium on Ride Microscopy*, (1955), pages 94–122; and T. James, *The Theory of the Photographic Process*, (McMillan 4th ed 1966), Chapter 2. The grain size can be measured by using the projected area of the grain or the approximate value of the diameter thereof.

For providing a desired gradation of the photographic material, two or more kinds of monodisperse silver halide emulsions having different grain sizes, or a plurality of grains having the same size, but different sensitivity may be mixed in the same layer in an emulsion layer having the same color-sensitivity or may be coated as multi-layers composed of separate layers.

Further, two or more kinds of polydisperse silver halide emulsions or a combination of a monodisperse emulsion and a polydisperse emulsion may be mixed or may be coated in the form of a multi-layer.

The shape of the silver halide grain of the present invention may be a regular crystal form, such as an octahedron or a tetrahedron, or may be an irregular crystal form, such as a sphere.

The grains may be flat tabular grains and an emulsion may be used in which at least 50% of the total projected area of the tabular grains is provided by grains having a ratio of length to thickness of at least 5, particularly at least 8. Further, the emulsions may be composed of grains, having a composite form of these crystal forms or a mixture thereof. The interior or surface of the grains in the silver halide emulsion of the present invention can be chemically sensitized by means of selenium sensitization, reduction sensitization or noble metal sensitization, alone or in combination.

Such chemical sensitization methods are described in more detail in, for example, *Research Disclosure*, No. 17643-II, page 23 (December 1978) and JP-A-62-21527.

The photographic emulsion of the present invention can be spectrally-sensitized by conventional methods using a photographic sensitizing dye. Examples of particularly useful dyes are cyanine dyes, merocyanine dyes and composite merocyanine dyes. These dyes may be used either alone or as a mixture of two or more of them. Further, these dyes may be used together with supersensitizers. Examples of the sensitizers are described in more detail in, for example, *Research Disclosure No.* 17643-V, pages 23–24 (December 1978).

Now, the compounds represented by the formula (I) are described in more detail.

In the formula (I), $M_1$ represents hydrogen atom, a cation or a protective group for the mercapto group, which can be cleaned by an alkali, and Z represents an atomic group necessary for forming of a five-membered or six-membered heterocyclic ring. The heterocyclic ring may be substituted or condensed. In more detail, $M_1$ is hydrogen, a cation (e.g., a sodium ion, potassium ion or ammonium ion) or a protective group (e.g., —COR', —COOR' or —$CH_2CH_2COR'$ wherein R' is hydrogen, an alkyl group, an aralkyl group or an aryl group preferably containing 1 to 12 carbon atoms) for the mercapto group with the cation and hydrogen being preferred, which can be cleaved by an alkali.

Z represents an atomic group required for forming of a five-membered or six-membered heterocyclic ring. The heterocyclic ring has one or more hetero-atoms such as sulfur, selenium, nitrogen, or oxygen, and may be condensed. One or more substituent groups may be attached on the heterocyclic ring or the condensed ring.

Examples of the heterocyclic ring formed by the Z group include tetrazole, triazole, imidazole, oxadole, thiadiazole, pyridine, pyrimidine, triazine, azabenzimidazole, purine, tetraazaindene, triazaindene, benzotriazole, benzimidazole, benzoxazole, benzthiazole, benzoselenazole and naphthoimidazole, with tetrazole, indazole, oxazole, thiadiazole and tetrazaindene being preferred and thiadiazole being the most preferred. Examples of the substituent groups on these rings include an alkyl group (e.g., methyl, ethyl, n-hexyl, hydroxyethyl, carboxyethyl), an alkenyl group (e.g., alkyl), an aralkyl group (e.g., benzyl, phenethyl), an aryl group (e.g., phenyl, naphthyl, p-acetamidophenyl, p-carboxyphenyl, m-hydroxyphenyl, p-sulfamoylphenyl, p-acetylphenyl, o-methoxyphenyl, 2,4-diethylaminophenyl, 2,4-dichlorophenyl), an alkylthio group (e.g., methylthio, ethylthio, n-butylthio), an arylthio group (e.g., phenylthio, naphthylthio), an aralkylthio group (e.g., benzylthio) and a mercapto group. The condensed ring may be substituted with nitro group, amino group, halogen atom, carboxyl group or sulfo group in addition to the above-described substituent groups.

Among the compounds represented by the formula (I), preferred examples thereof include, the following compounds, but the present invention is not to be construed as being limited thereto.

(I-1)
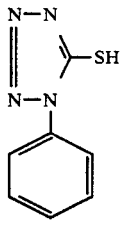
(I-2)
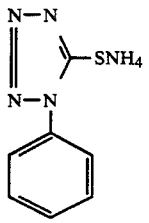
(I-3)
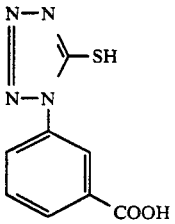
(I-4)
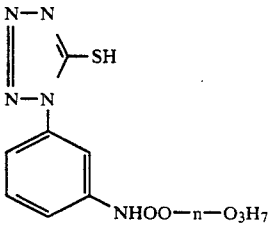
(I-5)
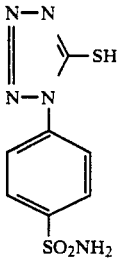
(I-6)
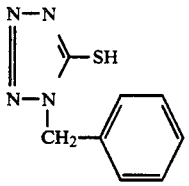
(I-7)
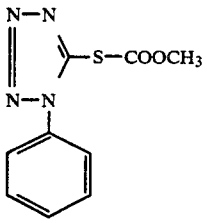
-continued
(I-8)
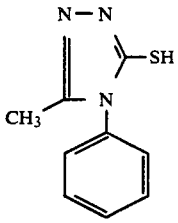
(I-9)
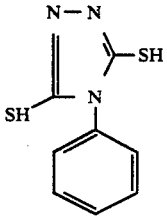
(I-10)
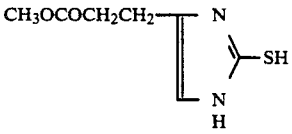
(I-11)
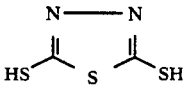
(I-12)
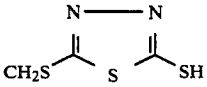
(I-13)
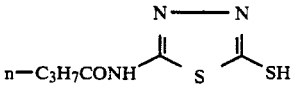
(I-14)
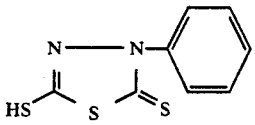
(I-15)
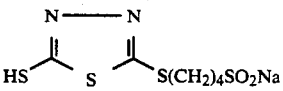
(I-16)
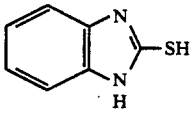
(I-17)
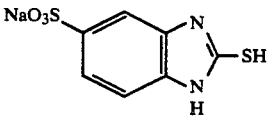
(I-18)
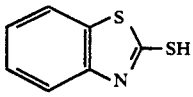

-continued (I-19)

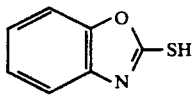

(I-20)

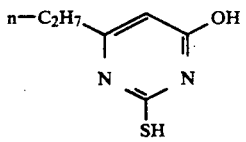

(I-21)

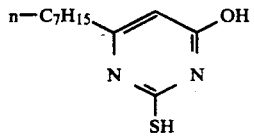

(I-22)

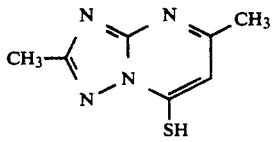

(I-23)

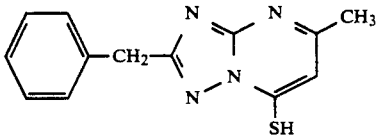

(I-24)

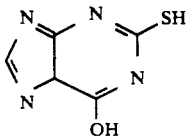

(I-25)

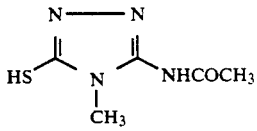

(I-26)

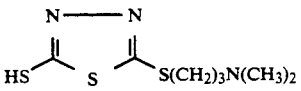

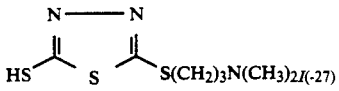

(I-27)

(I-28)

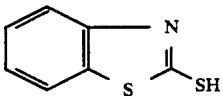

The compounds represented by formula (I) are incorporated in the photographic emulsion layer containing internal latent image type silver halide grains according to the present invention. The incorporation of the compounds of formula (I) in the emulsion may be conducted by adding the compounds to a coating solution containing the emulsion grains immediately before coating. It is preferred that the compounds are previously added to the emulsion of the present invention. It is more preferred that the compounds of formula (I) according to the present invention are added during the course of the grain formation of the internal latent image type silver halide grains of the present invention. It is most preferred that the compounds of formula (I) are added during the course of the formation of core grains or during the course of chemical sensitization of the core grains.

The amount of the compound of formula (I) is generally in the range of $10^{-6}$ to $10^{-2}$ mol, preferably $10^{-5}$ to $10^{-2}$ mol per mol of the internal latent image slider halide of the present invention.

The compounds of formula (I) according to the present invention may be used either alone or as a mixture of two or more of them.

The amount of the compounds of the present invention which is present in the silver halide grains can be determined in the interior of the grains by immersing the grains in a dilute solution of a solvent for the silver halide to dissolve the surfaces of the grains and the part in the vicinity of the surfaces thereof, separating the grains and conducting analysis By changing the degree of dissolution, it can be determined whether the compound having the formula (I) is present near the surfaces of the grains or exists deep in the interior of the grains.

The compounds represented by the formulae (II), (III) and (IV) are now described in more detail.

In the formulae (II), (III) and (IV), the alkyl group, the aryl group, the heterocyclic group, the aromatic ring and the heterocyclic ring represented by $Z_1$, $Y_1$ and $Y_2$ may be optionally substituted.

Examples of such substituent groups include a lower alkyl group (e.g., methyl, ethyl), an aryl group (e.g., phenyl), an alkoxy group having from 1 to 8 carbon atoms, a halogen atom (e.g., chlorine), a nitro group, an amino group and a carboxyl group.

Examples of the heterocyclic ring represented by $Z_1$, $Y_1$ and $Y_2$ include thiazole, benzothiazole, imidazole, benzimidazole, oxazole, benzoxazole and azole rings.

Examples of the metal atom represented by M include alkali metal ions (e.g., a sodium ion or potassium ion). Preferred examples of the organic cation include an ammonium ion and a guanidine group.

Typical examples of the compounds represented by the formulae (II), (III) and (IV) include the following compounds, but the present invention is not to be construed are being limited thereto:

1 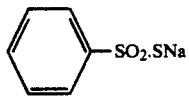

2 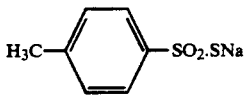

3 $H_3C.SO_2.SNa$

4 $H_5C_2.SO_2.SNa$ 5 n $H_7C_3.SO_2.SNa$ 6 n $H_9C_4.SO_2.SNa$ 7 n $H_{17}C_8.SO_2.SNa$ 8 n $H_{25}C_{12}.SO_2.SNa$ 9 n $H_{33}C_{16}.SO_2.SNa$

-continued

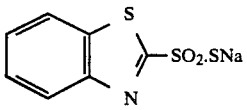

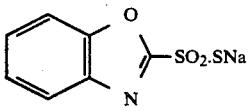

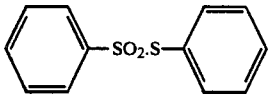

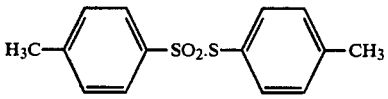

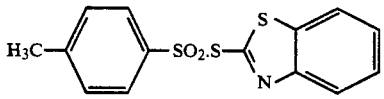

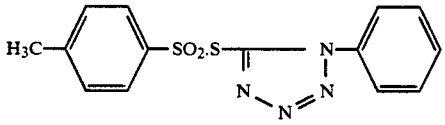

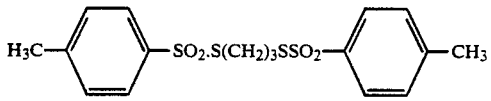

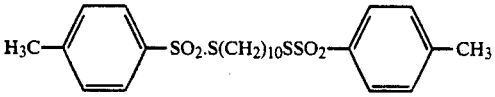

1-cistine-disulfoxide

The compounds represented by formulae (II), (III) and (IV) can be synthesized by well known methods.

For example, these compounds can be synthesized by reacting the corresponding sulfonyl chloride with sodium sulfide or by reacting sodium salt of the corresponding sulfinic acid with sulfur. These compounds are commercially available.

Among the compounds of formulae (II), (III) and (IV), those represented by formula (II) are preferred.

The compounds of formulae (II), (III) and (IV) of the present invention are incorporated in the photographic emulsion layer containing internal latent image type silver halide grains of the present invention.

The incorporation of the compounds in the emulsion layer may be conducted by adding the compounds to a coating solution containing the emulsion grains immediately before coating. It is preferred that the compounds are previously added to the emulsion. It is more preferred that the compounds of formulae (II), (III) and (IV) are added during the course of the grain formation of the internal latent image type silver halide grains of the present invention. It is most preferred that the compounds of formulae (II), (III) and (IV) are added during the course of the formation of core grains or during the course of chemical sensitization of core grains or conversion thereof.

The amount of the compound of formulae (II), (III) or (IV) is in the range of $10^{-6}$ to $10^{-2}$ mol, preferably $10^{-5}$ to $10^{-2}$ mol per mol of the internal latent image type silver halide.

The compounds of formulae (II), (III) and (IV) may be used either alone or as a mixture of two or more of them.

The amount of the compound of the present invention, present in the silver halide grains, can be determined in the interior of the grains by immersing the grains in a dilute solution of a solvent for silver halide to dissolve the surfaces of the grains and the region in the vicinity of the surfaces thereof, separating the grains and conducting analysis. By changing the degree of dissolution, it can be determined whether the compounds of formulae (II), (III) and (IV) are present near the surfaces thereof or are deep in the interior of the grains.

According to the present invention, it is preferable to use the compound of formulae (I), (II), (III) and (IV) by way of the combination of the compound of formula (I) and at least one compound of formulae (II), (III) and (IV).

The photographic emulsion of the present invention may contain benzenesulfinic acids or thiocarbonyl compounds for the purpose of preventing fogging during the manufacturing of the photographic material, the storage thereof or photographic processing, or for the purpose of stabilizing photographic performance.

Examples of fog inhibitors or stabilizers and methods for using them are described in, for example, U.S. Pat. Nos. 3,954,474 and 3,982,947, JP-B-52-28660, *Research Disclosure* (RD) No. 17643 (December 1978) VIA-VIM and E. J. Birr., Stabilization of Photographic Silver Halide Emulsions.

Various color couplers can be used to form direct positive color images in the present invention. The color coupler is a compound which couples with an oxidized aromatic primary amine color developing agent to form or release a substantially non-diffusible dye, and which is preferably a substantially non-diffusible compound.

Typical examples of the useful color couplers include naphthol or phenol compounds, pyrazolone or pyrazoloazole compounds and linear or heterocyclic ketomethylene compounds. Examples of these cyan, magenta and yellow couplers include compounds described in *Research Disclosure* Nos. 17643, P-25, VII-IX (December 1978), 18717 (November 1979), JP-A-62-215272 and patents described in these publications.

Colored couplers for correcting unnecessary absorption in the region of short wavelengths of the formed dye, couplers giving color dyes having proper diffusibility, colorless couplers, DIR couplers releasing a development inhibitor by a coupling reaction or polymer couplers can be used.

As a binder or protective colloid for the emulsion layer or intermediate layer of the photographic material of the present invention, gelatin is advantageously used, but other hydrophilic colloids also can be used.

Color fogging inhibitions or color mixing inhibitors may be used in the photographic material of the present invention.

Typical examples of these inhibitors are described in JP-A-62-215272.

The photographic material of the present invention may contain various anti-fading agents. Typical examples of the anti-fading agents are disclosed in JP-A-62-215272.

Further, the photographic material of the present invention may contain additives such as anti-irradiation or antihalation dyes, ultraviolet light absorbers, plasticizers, fluorescent brightening agents, matting agents, air fogging inhibitors, coating aids, antistatic agents, and slipperiness improvers. Typical examples of these additives are described in *Research Disclosure* Nos. 17643 VIII–XIII, pages 25–27 (December 1978) and 10716, pages 47–651 (November 1979).

The photographic material of the present invention may optionally have auxiliary layers such as a protective layer, intermediate layer, filter layer, antihalation layer, backing layer, or white light reflecting layer, in addition to the silver halide emulsion layer(s).

The photographic emulsion layer and other layers of the photographic material of the present invention are coated on a support, such as those described in *Research Disclosure* No. 17043, XVII, page 20 (December 1978), European Patent 0,102,203 and JP-A-61-97655. The coating method described in *Research Disclosure* No. 17643 XV, pages 20–29 can be used.

The present invention includes various color photographic materials.

Typical examples thereof include reversal color film, reversal color paper and instant color film for slide and television use.

The present invention also includes color hard copy materials for full color duplicator or for preserving CRT images. The present invention includes monochromatic photographic materials utilizing a trichromatic coupler mixture described in *Research Disclosure,* No. 17123 (July (1970). Further, the present invention includes black-and-white photographic materials. Examples of the black-and-white (B/W) photographic materials, of the present invention include direct positive type photographic materials (e.g., photographic materials for X-ray photography, duplicating photographic materials, micro photographic materials, photocomposing photographic materials, and printing photographic materials) described in JP-A-59-200540 and JP-A-60-260039.

The direct positive photographic material according to the present invention is subjected to a fogging treatment after imagewise exposure. As the fogging treatment, any conventional method can be used, including a "light fogging method" in which the whole surface of the sensitive layer is exposed and a "chemical fogging method", in which development is carried out in the presence of a nucleating agent. The development may be conducted in the presence of a nucleating agent and fogging light, or a photographic material containing a nucleating agent may be subjected to fogging exposure. It is preferred in the present invention that the fogging treatment is carried out in the presence of a nucleating agent.

The whole surface exposure, i.e., fogging exposure in the light fogging method of the present invention, is carried out before and/or during development treatment after imagewise exposure. The imagewise exposed photographic material is exposed in a developing solution or by immersing it in a pre-bath for the developing solution. Alternatively, after the imagewise exposed photographic material is taken out from these solutions, the exposure is conducted before the material is dried. It is most preferred that the exposure is conducted in a developing solution.

As light source for fogging exposure, there can be used any of light sources within the sensitive wavelengths of the photographic materials. For example, a fluorescent lamp, tungsten lamp, xenon lamp, or sunlamp can be used. Examples of such light sources are described in U.K. Patent 1,151,363, JP-B-45-12710, JP-B-45-12709, JP-B-58-6936, JP-A-48-9727, JP-A-56-137350, JP-A-57-129438, JP-A-58-62652, JP-A-58-70223 (corresponding to U.S. Pat. No. 4,440,851) and JP-A-58-120248.

As the nucleating agent of the present invention, there can be used any conventional compounds which have been developed for the purpose of nucleating the internal latent image silver halide. The nucleating agents may be used either alone or as a combination of two or more compounds. Examples of the nucleating agents include those described in *Research Disclosure* Nos. 22534, pages 50–54 (January 1983), 15162, pages 76–77 (November 1976) and 23510, pages 346–352 (November 1983). These agents can be roughly classified into the three groups consisting of quaternary hetetrocyclic compounds (hereinafter referred to as [N-I]), hydrazine compounds (hereinafter referred to as [N-II]) and other compounds.

Typical examples of [N-I] nucleating agents include the following compounds, but the present invention is not to be construed as being limited thereto:

(N-I-1) 5-Ethoxy-2-methyl-1-propargylquinolinium bromide (N-I-2) 2,4-Dimethyl-1-propargylquinolinium bromide (N-I-3) 2-methyl-1-(3-[2-(4-methylphenyl)hydrazono) butyl] quinolinium iodide (N-I-4) 3,4-Dimethyl-dihydropyrrolido[2,1-b]benzothiazolium bromide (N-I-5) 6-Ethoxythiocarbonylamino-2-methyl-1-propargylquinolinium trifluoromethanesulfonate (N-I-6) 2-Methyl-6-(3-phenylthioureido) -1-propargylquinolinium bromide (N-I-7) 6-(5-benzotriazolcarboxyamido)-2-methyl-1-propargylquinolinium trifluoromethanesulfonate (N-I-8) 6-[3-(2-mercaptoethyl)ureido]-2-methyl-1-propargylquinolinium trifluoromethanesulfonate (N-I-9) 6-(3-[3-(5-mercapto-1,3,4-thiadiazol-2-ylthio)-propyl]ureido)- 2-methyl-1-propargylquinolinium trifluoromethanesulfonate (N-I-10) 6-(5-mercaptotetrazol-1-yl)-2-methyl-1-propargylquinolinium iodide Examples of [N-II] nucleating agents include the following compounds, but the present invention is not to be construed as being limited thereto:

(N-II-1) 1-Formyl-2-(4-[3-(2-methoxyphenyl)ureido]-phenyl)hydrazine (N-II-2) 1-Formyl-2-(4-[3-{3-(3-2,4-di-tertpentylphenoxy)propyl]uredio}-phenylsulfonylamino]-phenyl)hydrazine (N-II-3) 1-Formyl-2-(4-[3-(5-mercapto-tetrazol-1-yl) benzamide]phenyl)-hydrazine (N-II-4) 1-Formyl-2-[4-(3-[3-(5-mercapto-tetrazol-1-yl)phenyl]ureido)phenyl]-hydrazine (N-II-5) 1-Formyl-2-[4-(3-[N-(5-mercapto-4-methyl-1,2,4-triazol-3-yl)carbomoyl]-propaneamido) phenyl]hydrazine (N-II-6) 1-Formyl-2-(4-[3-(N-[4-(3-mercapto-1,2,4-triazol-4-yl)phenyl]-carbamoyl)propaneamido]-phenyl)hydrazine (N-II-7) 1-Formyl-2-[4-(3-[N-(5-mercapto-1,3,4-thiadiazol-2-yl)carbamoyl]propaneamido) phenyl]hydrazine (N-II-8) 2-[4-benzotriazol-5-carboxamido)phenyl]-1-formylhydrazine (N-II-9) 2-[4-{3-(N-(benzotriazol-5-carboxamido) carbamoyl}propaneamido)phenyl]-1-formyl hydrazine (N-II-10) 1-Formyl-2-[4-[1-(N-phenylcarbamoyl) -thiosemicarbamido]phenyl]hydrazine Other examples of the hydrazine nucleating agents include those described in JP-A-57-86829, and U.S. Pat. Nos. 4,560,638, 4,478,928, 2,563,785 and 2,588,982.

In the present invention, nucleating accelerators can be used to accelerate the action of the nucleating agent. As the nucleating accelerators, there can be added to the nucleating agent, tetrazaindenes, triazaindenes, and pentaazaindenes, these indene compounds having at least one mercapto group which may be optionally substituted with an alkali metal atom or ammonium group. Further, compounds described in Japanese Patent Application Nos. 61-136948 (pages 2-6 and 16-43) and JP-A-63-106656 can be used.

Color developing solutions which are used for the development of the photographic material of the present invention are aqueous alkaline solutions mainly composed of preferably aromatic primary amine color developing solutions. As the color developing solutions, aminophenol compounds are useful, but p-phenylenediamine compounds are more preferred. Typical examples thereof include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamido-ethylaniline, 3-methyl-4-amino-N-ethyl-N-$\beta$-methoxyethylaniline and salts thereof such as sulfates, hydrochlorides and p-toluenesulfonates. If desired, these compounds may be used in a combination of two or more of them according to the use thereof.

The pH of the color developing solution is in the range of 9 to 12, preferably 9.5 to 11.5.

After the color development, the photographic emulsion layer is usually bleached. The bleaching treatment may be carried out simultaneously with fixing (bleaching-fixing treatment), or may be conducted separately. To accelerate the treatment, bleaching-fixing treatment may be conducted after bleaching. Two tanks may be used and the emulsion layer may be processed in bleaching and fixing baths, or may be subjected to the fixing treatment before the bleaching-fixing treatment is carried out. Alternatively, the emulsion layer may be bleached after the bleaching-fixing treatment.

Usually, the silver halide color photographic material of the present invention is desilvered and then fed to a rinsing stage and/or a stabilization stage. The amount of water in the rinsing stage can be widely set depending on the characteristics (depending on the materials such as couplers) of the photographic material, the use thereof, the temperature of rinsing water, the number of rinsing tanks (the number of steps), the replenishing system such as a countercurrent or co-current system and other conditions. The relationship between the number of rinsing tanks and the amount of water in a multi-stage countercurrent system can be determined by using the method described in *Journal of The Society of Motion Picture and Television Engineers*, Vol. 64, pages 248-253 (May 1955).

If desired, the color developing solution may be incorporated into the silver halide color photographic material of the present invention to simplify and expedite processing. For the purpose of incorporation, it is preferred to use precursors of the color developing agents.

On the other hand, conventional developing agents can be used to develop the black-and-white photographic material of the present invention. Examples thereof include polyhydroxybenzenes such as hydroquinone, 2-chlorohydroquinone, 2-methylhydroquinone, catechol and pyrogallol; aminophenols such as p-aminophenol, N-methyl-p-aminophenol and 2,4-diaminophenol; 3-pyrazolidones such as 1-phenyl-3-pyrazolidone, 1-phenyl-4,4'-dimethyl-3-pyrazolidone, 1-phenyl-4-methyl-4-hydroxymethyl-3-pyrazolidone and 5,5-dimethyl-1-phenyl-3-pyrazolidone; and ascorbic acids. These compounds may be used either alone or as a mixture of two or more of them. The developing solutions described in JP-A-58-55928 can also be used.

Specific examples of developing agents, preservatives and buffering agents for the black-and-white photographic material, developing methods and method for using them are described in, for example, *Research Disclosure*, No. 17643, XIX-XXI (December 12, 1978).

EXAMPLES

The present invention is now illustrated in more detail with reference to the following examples which, are not to be construed as limiting the scope of the present invention in any way. Unless otherwise indicated, all parts, percents and ratios are by weight.

EXAMPLE 1

Preparation of Emulsion 1

An aqueous solution of potassium bromide containing 17.2 g KBr and an aqueous solution of silver nitrate containing 24 g $AgNO_3$ were added simultaneously to an aqueous gelatin solution containing 0.3 g (per mol of Ag) of 3,4-dimethyl-1,3-thiazoline-2-thione added thereto with vigorous stirring at 75° C. over a period of 20 minutes to obtain an octahedral monodisperse silver bromide core emulsion having a mean grain size of about 0.40 $\mu$m. 6 mg (per mol of silver) of sodium thiosulfate and 7 mg (per mol of silver) of chloroauric acid (tetrahydrate) were added to this emulsion. The mixture was heated at 75° C. for 80 minutes to carry out the chemical sensitization treatment of the core. A shell was formed on the thus-obtained silver bromide grain core in the same precipitation conditions as those in the first treatment to finally obtain an octahedral monodisperse core/shell silver bromide emulsion having a mean grain size of about 0.7 $\mu$m. The coefficient of variation of grain size was about 10%.

1.5 mg (per mol of silver) of sodium thiosulfate and 1.5 mg (per mol of silver) of chloroauric acid (tetrahydrate) were added to the emulsion. The mixture was heated at 60° C. for 60 minutes to carry out the chemical sensitization treatment of the shell, thus obtaining an internal latent image type silver halide emulsion 1.

The above-described procedure for preparing emulsion 1 was repeated except that amount of KBr and $AgNO_3$ were changed to 134 g and 96 g, respectively, and each compound given in Table 1 was added immediately after the core emulsion was obtained to obtain each of emulsions 2 to 10.

TABLE 1

| Emulsion No. | Compound | Amount added (mol/mol of Ag) |
|---|---|---|
| 1 | — | $2.5 \times 10^{-4}$ |
| 2 | I-1 | " |
| 3 | I-3 | " |
| 4 | I-8 | " |
| 5 | I-12 | " |
| 6 | I-16 | " |
| 7 | I-18 | " |
| 8 | I-21 | " |
| 9 | I-22 | " |
| 10 | I-25 | " |

The following photographic material was prepared using the emulsion 1.

The support was a paper support (thickness 100 μm) (both sides were laminated with polyethylene). The side to be coated contained titanium white as a white pigment.

Composition of Sensitive Layer

The ingredients and coating weights in g/m² given below were used. The amount of silver halide is given as the coating weight in terms of silver.

| | |
|---|---|
| First layer (high-sensitivity red sensitive layer) | |
| Emulsion 1 which has been spectrally-sensitized with red sensitizing dye (ExS-1, 2, 3) | 0.14 |
| Gelatin | 1.00 |
| Cyan coupler (ExC-1) | 0.15 |
| Cyan coupler (ExC-2) | 0.15 |
| Fading inhibitor (Cpd 2, 3, 4, 13 in equal amounts) | 0.15 |
| Coupler dispersing medium (Cpd-5) | 0.03 |
| Solvent for coupler (Solv-1, 2, 3 in general amounts) | 0.10 |
| Second layer (protective layer) | |
| Acrylic-modified copolymer of polyvinyl alcohol (degree of modification: 17 wt %) | 0.02 |
| Polymethyl methacrylate particles (average particle size: 2.4 μm), silicon oxide (average particle size: 5 μm) in equal amounts | 0.05 |
| Gelatin | 1.50 |
| Hardener for gelatin (H-1) | 0.17 |

In the first layer, $10^{-3}$ wt. % ExZK-1 as a nucleating agent and $10^{-2}$ wt. % Cpd-24 as a nucleating accelerator were used, each amount being based on the coating weight of silver halide. Further, Alknol XC (du Pont) and sodium alkylbenzenesulfonate as emulsion dispersing aids and succinic ester and Magefac F-120 (Dainippon Ink & Chemicals Inc.) as coating aids were used in each layer. Cpd-19,20,21 as stabilizers were used in the first layer. The resulting sample was referred to as sample No. 101.

The above-described procedure for preparing sample No. 101 was repeated except that each of emulsions 2 to 10 was used in place of the emulsion 1 to prepare each of sample Nos. 102 to 110.

The samples were subjected to wedge exposure (1/10 seconds, 20 CMS) through a red filter and then to the following treatments.

| Processing stage | Time (sec) | Temp. (°C.) | Replenishing amount (ml/m²) |
|---|---|---|---|
| Color development | 90 | 38 | 300 |
| Bleaching fixing | 40 | 35 | 300 |
| Rinsing ① | 40 | 30–36 | |

-continued

| Processing stage | Time (sec) | Temp. (°C.) | Replenishing amount (ml/m²) |
|---|---|---|---|
| Rinsing ② | 40 | 30–36 | |
| Rinsing ③ | 15 | | 320 |
| Drying | 30 | 75–80 | |

The replenishing system of rinsing water was a countercurrent system in which the rinsing bath ③ was replenished with rinsing water, the rinsing bath ② was replenished with overflow liquid from the rinsing bath ③ and the overflow liquid from the rinsing bath ② was introduced into the rinsing bath ①. The amount carried over from the previous bath by the photosensitive material was 35 ml/m² so that the replenishing ratio was 9.1.

| Color developing solution | Solution | Replenisher |
|---|---|---|
| Ethylenediaminetetrakis-methylenephosphonic acid | 0.5 g | 0.5 g |
| Diethylene glycol | 8.0 g | 13.0 g |
| Benzyl alcohol | 12.0 g | 18.5 g |
| Sodium bromide | 0.6 g | — |
| Sodium chloride | 0.5 g | — |
| Sodium sulfite | 2.0 g | 2.5 g |
| N,N-Diethylhydroxyamine | 3.5 g | 4.5 g |
| Triethylenediamine(1,4-diazabicyclo[2,2,2]octane) | 3.5 g | 4.5 g |
| 3-Methyl-4-amino-N-ethyl-N-(β-methanesulfonamidoethyl)-aniline sulfate | 5.5 g | 8.0 g |
| Potassium carbonate | 30.0 g | 30.0 g |
| Fluorescent brightener (stilbene compound) | 1.0 g | 1.3 g |
| By adding pure water | 1000 ml | 1000 ml |
| pH | 10.50 | 10.90 |

The pH was adjusted by potassium hydroxide or hydrochloric acid.

| Bleaching fixing solution | Solution = replenisher |
|---|---|
| Ammonium thiosulfate | 100 g |
| Sodium hydrogensulfite | 21.0 g |
| Iron (III) ammonium ethylenediaminetetraacetate dihydrate | 50 g |
| Disodium ethylenediaminetetraacetate dihydrate | 5.0 g |
| By adding pure water | 1000 ml |
| pH | 6.3 |

The pH was adjusted by ammonia water or hydrochloric acid.

Rinsing Water

Pure waster was used (solution=replenisher).

The term "pure water" as used herein refers to water in which all cations (excluding hydrogen ions) and all anions (excluding hydroxyl ions) in tap water were removed by ion-exchange treatment to a concentration of 1 ppm or below.

The cyan color density of the resulting direct positive image was measured. The results are shown in Table 2.

TABLE 2

| Sample No. | Emulsion No. | Compound added | Dmax* | Dmin* |
|---|---|---|---|---|
| 101 (Comp. Ex.) | 1 | — | 0.90 | 0.20 |

TABLE 2-continued

| Sample No. | Emulsion No. | Compound added | Dmax* | Dmin* |
|---|---|---|---|---|
| 102 (Invention) | 2 | I-1 | 1.10 | 0.15 |
| 103 (Invention) | 3 | I-3 | 1.12 | 0.14 |
| 104 (Invention) | 4 | I-8 | 1.15 | 0.14 |
| 105 (Invention) | 5 | I-12 | 1.17 | 0.13 |
| 106 (Invention) | 6 | I-16 | 1.15 | 0.13 |
| 107 (Invention) | 7 | I-18 | 1.15 | 0.12 |
| 108 (Invention) | 8 | I-21 | 1.14 | 0.13 |
| 109 (Invention) | 9 | I-22 | 1.17 | 0.15 |
| 110 (Invention) | 10 | I-25 | 1.17 | 0.14 |

It was found that the samples 102 to 110 containing the compounds of the present invention gave favorable results, i.e., maximum image density (Dmax) was high and minimum image density was low.

EXAMPLE 2

The following emulsions 21 to 25 were prepared by changing the stage of the addition of the compound I-12 in the preparation of the emulsion 5 as given in Table 3.

TABLE 3

| Emulsion No. | Stage of addition of compound I-12 |
|---|---|
| 21 | During the formation of the core (when 75% of silver nitrate for core formation had been added) |
| 5 | Immediately after the formation of the core emulsion |
| 22 | After the completion of chemical sensitization of the core |
| 23 | During the formation of the shell (when 50% of silver nitrate for shell formation had been added) |
| 24 | Immediately after the formation of the shell |
| 25 | After the completion of chemical sensitization of the shell |

The procedure of the preparation of sample 101 was repeated except that each of the emulsions 21 to 25 was used in place of the emulsion 1 to prepare each of samples 221 to 225.

Further, after the coating solution for the first layer was prepared in the preparation of the sample 101, the compound I-12 was added in such an amount as to give a concentration of $2.5\times10^{-4}$ mol/mol of Ag, thus preparing a sample 231.

These samples were exposed in the same way as in Example 1. The cyan color density of the resulting direct positive image was measured. The results are shown in Table 4.

TABLE 4

| Sample No. | Emulsion No. | Compound added | Dmax | Dmin |
|---|---|---|---|---|
| 101 (Comp. Ex.) | 1 | — | 0.90 | 0.20 |
| 221 (Invention) | 21 | I-12 | 1.16 | 0.13 |
| 105 (Invention) | 5 | " | 1.17 | 0.13 |
| 222 (Invention) | 22 | " | 1.10 | 0.14 |
| 223 (Invention) | 23 | " | 1.05 | 0.15 |
| 224 (Invention) | 24 | " | 1.05 | 0.15 |
| 225 (Invention) | 25 | " | 1.00 | 0.16 |
| 231 (Invention) | 1 | " | 0.95 | 0.16 |

It is apparent from Table 4 that the samples containing the compound of the present invention provided superior results, wherein Dmax was high and Dmin was low as compared with the sample which did not contain the compound of the present invention.

As to when the compound of the present invention is to be added, it is preferred to add the compound of the present invention during the formation of the emulsion and it is less preferred to add it after the preparation of the coating solution. It is most preferred to add the compound during the formation of the core or before chemical sensitization of the core.

EXAMPLE 3

The following photographic material was prepared by using the emulsion 1.

The support was a paper support (thickness: 150 μm) (polyethylene was laminated onto both sides) and the side to be coated contained titanium white as white pigment.

Composition of Sensitive Layer

The ingredients and coating weights in g/m2 given below were used. The amount of silver halide is given as the coating weight in terms of silver.

| | |
|---|---|
| First layer (high-sensitivity red sensitive layer) | |
| Emulsion 1 which had been spectrally-sensitized with red sensitizing dye (ExS-1,2,3) | 0.14 |
| Gelatin | 1.00 |
| Cyan coupler (ExC-1) | 0.15 |
| Cyan coupler (ExC-2) | 0.15 |
| Fading inhibitor (Cpd-2,3,4,13 in equal amounts) | 0.15 |
| Coupler dispersing medium (Cpd-5) | 0.03 |
| Solvent for coupler (Solv-1,2,3 in equal amounts) | 0.10 |
| Second layer (protective layer) | |
| Acrylic-modified copolymer of polyvinyl alcohol (degree of modification: 17%.) | 0.02 |
| Polymethyl methacrylate particles (average particle size: 2.4 μm), silicon oxide (average particle size: 5 μm) in equimolar | 0.05 |
| Gelatin | 1.50 |
| Hardener for gelatin (H-1) | 0.17 |

Alkanol XC (du Pont) and sodium alkylbenzenesulfonate as emulsion dispersion aids and succinic ester and Magefac F-120 (Dainippon Ink & Chemicals Inc.) as coating aids were used in each layer. In the first layer, stabilizers (Cpd-19,20,21) were used. The resulting sample was referred to as sample No. 301.

The procedure for preparation of sample 301 was repeated except that each of the emulsions 2,4,5 and 10 was used in place of the emulsion 1 to prepare samples 302 to 305, respectively.

The samples were subjected to wedge exposure (1/10 second, 20 CMS) through a red filter and then processed in the same way as in Example 1.

The film of the photographic material was continuously irradiated with light at 0.5 lux (color temperature 4500K) for 15 seconds after the lapse of 15 seconds from the beginning of color development.

The cyan color density of the resulting direct positive image was measured. The results are shown in Table 5.

TABLE 5

| Sample No. | Emulsion No. | Compound added | Dmax | Dmin |
|---|---|---|---|---|
| 301 (Comp. Ex.) | 1 | — | 0.72 | 0.21 |
| 302 (Invention) | 2 | I-1 | 0.91 | 0.15 |
| 303 (Invention) | 4 | I-8 | 0.95 | 0.14 |
| 304 (Invention) | 5 | I-12 | 0.97 | 0.14 |

TABLE 5-continued

| Sample No. | Emulsion No. | Compound added | Dmax | Dmin |
|---|---|---|---|---|
| 305 (Invention) | 10 | I-25 | 0.95 | 0.14 |

It is apparent that the samples containing the compounds of the present invention provided excellent results, since Dmax was high and Dmin was low.

EXAMPLE 4

The following photographic material was prepared by using the emulsion 1.

Polyethylene was laminated onto both sides of a paper support. On the surface side of the paper support (thickness: 100 μm), there were coated the following first to fourteenth layers in a multi-layer form. On the back side thereof, there were coated the following fifteenth and sixteenth layers in a multi-layer form to prepare a color photographic material. The polyethylene on the side coated with the first layer contained titanium white as white pigment and a trace amount of ultramarine as blue dye.

Composition of Sensitive Layer

The ingredients and coating weights in g/m$^2$ given below were used. The amount of silver halide is given as the coating weight in terms of silver. Emulsions used in each layer were prepared according to the procedure used to prepare emulsion 1. A Lipmann emulsion was used for the 14th layer, i.e., an emulsion not subjected to surface chemical sensitization.

| | |
|---|---|
| First layer (antihalation layer) | |
| Black colloidal silver | 0.10 |
| Gelatin | 1.30 |
| Second layer (intermediate layer) | |
| Gelatin | 0.70 |
| Third layer (low-sensitivity red sensitive layer) | |
| Silver bromide which had been spectrally-sensitized with red sensitizing dye (ExS-1, 2, 3) (mean grain size 0.3 μm, size distribution (coefficient of variation) 8%, octahedron) | 0.06 |
| Silver bromide which had been spectrally-sensitized with red sensitizing dye (ExS-1, 2, 3) (mean grain size 0.45 μm, size distribution 10%, octahedron) | 0.10 |
| Gelatin | 1.00 |
| Cyan coupler (ExC-1) | 0.11 |
| Cyan coupler (ExC-2) | 0.10 |
| Fading inhibitor (Cpd-2, 3, 4, 13 in equal amounts) | 0.12 |
| Coupler dispersing medium (Cpd-5) | 0.03 |
| Solvent for coupler (Solv-1, 2, 3 in equal amounts) | 0.06 |
| Fourth layer (high-sensitivity red sensitive layer) | |
| Silver bromide which had been spectrally-sensitized with red sensitizing dye (ExS-1, 2, 3) (mean grain size 0.60 μm, size distribution 15%, octahedron) | 0.14 |
| Gelatin | 1.00 |
| Cyan coupler (ExC-1) | 0.15 |
| Cyan coupler (ExC-2) | 0.15 |
| Fading inhibitor (Cpd-2, 3, 4, 13 in equal amounts) | 0.15 |
| Coupler dispersing medium (Cpd-5) | 0.03 |
| Solvent for coupler (Solv-1, 2, 3 in equal amounts) | 0.10 |
| Fifth layer (intermediate layer) | |
| Gelatin | 1.00 |
| Color mixing inhibitor (Cpd-7) | 0.08 |
| Solvent for inhibiting color mixing (Solv-4, 5 in equal amounts) | 0.16 |

-continued

| | |
|---|---|
| Polymer latex (Cpd-8) | 0.10 |
| Sixth layer (low-sensitivity green sensitive layer) | |
| Silver bromide which had been spectrally-sensitized with green sensitizing dye (ExS-3) (mean grain size 0.25 μm, grain size distribution 11%, octahedron) | 0.04 |
| Silver bromide which had been spectrally-sensitized with green sensitizing dye (ExS-3, 4) (mean grain size 0.45 μm, grain size distribution 11%, octahedron) | 0.06 |
| Gelatin | 0.80 |
| Magenta coupler (ExM-1, 2 in equal amounts) | 0.11 |
| Fading inhibitor (Cpd-9) | 0.10 |
| Stain inhibitor (Cpd-10, 22 in equal amounts) | 0.014 |
| Stain inhibitor (Cpd-23) | 0.001 |
| Stain inhibitor (Cpd-12) | 0.01 |
| Coupler dispersing medium (Cpd-5) | 0.05 |
| Solvent for coupler (Solv-4, 6 in equal amounts) | 0.15 |
| Seventh layer (high-sensitivity green sensitive layer) | |
| Emulsion 1 which had been spectrally-sensitized with green sensitizing dye (ExS-3, 4) (mean grain size 0.1 μm, grain size distribution 16%, octahedron) | 0.10 |
| Gelatin | 0.80 |
| Magenta coupler (ExM-1, 2) | 0.11 |
| Fading inhibitor (Cpd-8) | 0.10 |
| Stain inhibitor (Cpd-10, 22 in equal amounts) | 0.013 |
| Stain inhibitor (Cpd-23) | 0.001 |
| Stain inhibitor (Cpd-12) | 0.01 |
| Coupler dispersing medium (Cpd-5) | 0.05 |
| Solvent for coupler (Solv-4, 5 in equal amounts) | 0.15 |
| Eighth layer (intermediate layer) | |
| Same as fifth layer | |
| Ninth layer (yellow filter layer) | |
| Yellow colloidal silver | 0.20 |
| Gelatin | 1.00 |
| Fading inhibitor (Cpd-7) | 0.06 |
| Solvent for color mixing inhibitor (Solv-4, 5 in equal amounts) | 0.15 |
| Polymer latex (Cpd-8) | 0.10 |
| Tenth layer (intermediate layer) | |
| Same as fifth layer | |
| Eleventh layer (low-sensitivity blue sensitive layer) | |
| Silver bromide which had been spectrally-sensitized with blue sensitizing dye (ExS-5, 6) (mean grain size 0.45 μm, grain size distribution 8%, octahedron) | 0.07 |
| Silver bromide which had been spectrally-sensitized with blue sensitizing dye (ExS-5, 6) (mean grain size 0.60 μm, grain size distribution 14%, octahedron) | 0.10 |
| Gelatin | 0.50 |
| Yellow coupler (ExY-1) | 0.22 |
| Stain inhibitor (Cpd-11) | 0.001 |
| Fading inhibitor (Cpd-6) | 0.10 |
| Coupler dispersing medium (Cpd-5) | 0.05 |
| Solvent for coupler (Solv-2) | 0.05 |
| Twelfth layer (high-sensitivity blue sensitive layer) | |
| Silver bromide which had been spectrally-sensitized with blue sensitizing dye (ExS-5, 6) (mean grain size 1.2 μm, grain size distribution 21%, octahedron) | 0.25 |
| Gelatin | 1.00 |
| Yellow coupler (ExY-1) | 0.41 |
| Stain inhibitor (Cpd-11) | 0.002 |
| Fading inhibitor (Cpd-6) | 0.10 |
| Coupler dispersing medium (Cpd-5) | 0.05 |
| Solvent for coupler (Solv-2) | 0.10 |
| Thirteenth layer (ultraviolet light absorbing layer) | |
| Gelatin | 1.50 |
| Ultraviolet light absorber (Cpd-1, 3, 13 in equal amounts) | 1.00 |
| Color mixing inhibitor (Cpd-6, 14 in equal amounts) | 0.06 |
| Dispersion medium (Cpd-5) | 0.05 |
| Solvent for ultraviolet light absorber | 0.15 |

-continued

| | |
|---|---|
| (Solv-1, 2 in equal amounts) | |
| Irradiation inhibiting dye (Cpd-15, 16 in equal amounts) | 0.02 |
| Irradiation inhibiting dye (Cpd-17, 18 in equal amounts) | 0.02 |
| Fourteenth layer (protective layer) | |
| Finely divided silver chlorobromide (silver chloride: 97 mol %, mean grain size: 0.2 μm) | 0.05 |
| Acrylic-modified copolymer of polyvinyl alcohol (degree of modification: 17 wt %) | 0.02 |
| polymethyl metiacrylate particles (average particle size 2.4 μm), silicon oxide (average particle size 5 μm) in equal amounts | 0.05 |
| Gelatin | 1.50 |
| Hardener for gelatin (H-1) | 0.17 |
| Fifteenth layer (backing layer) | |
| Gelatin | 2.50 |
| Sixteenth layer (backing-protective layer) | |
| Polymethyl methacrylate particle (average particle size 2.4 μm), silicon oxide (average particle size 5 μm) in equal amounts | 0.05 |
| Gelatin | 2.00 |
| Hardener for gelatin (H-1) | 0.11 |

In each sensitive layer, $10^{-3}$ wt. % ExZk-1 as a nucleating agent and $10^{-2}$ wt. % Cpd-24 as a nucleating accelerator were used, each amount being based on the coating weight of silver halide. Alkanol XC (du Pont) and sodium alkylbenzenesulfonate as emulsion dispersion aids and succinic ester and Magefac F-120 (Dainippon Ink & Chemicals Inc.) as coating aids were used in each layer. Further, stabilizers (Cpd-19,20,21) were used in the layer containing silver halide and colloidal silver. This sample was referred to as sample No. 401.

The compounds used in Examples 1, 2, 3 and 4 were had the following structural formulas:

ExS-1

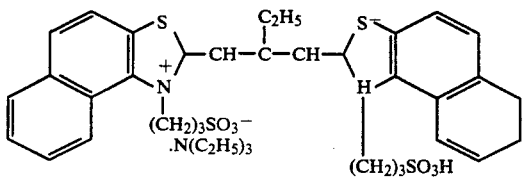

ExS-2

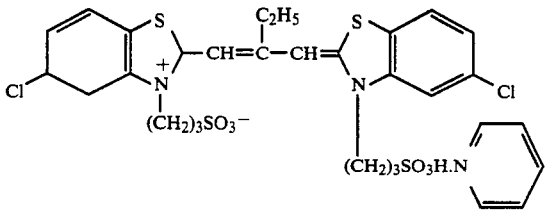

ExS-3

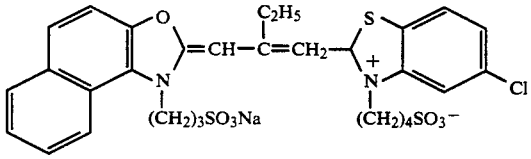

ExS-4

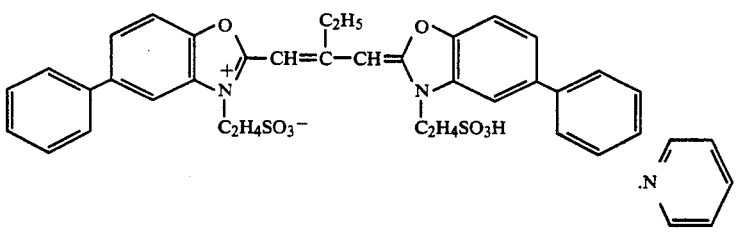

ExS-5

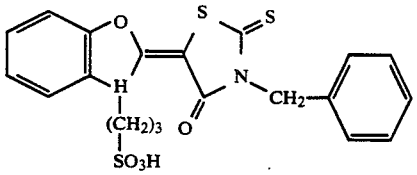

ExS-6

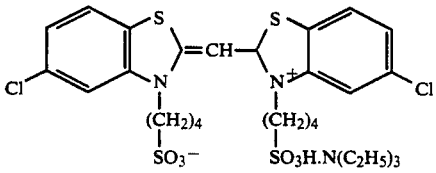

-continued
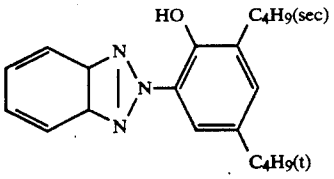
Cpd-1
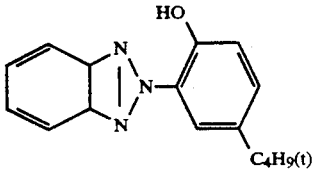
Cpd-2
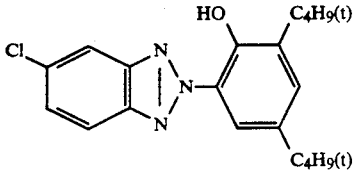
Cpd-3
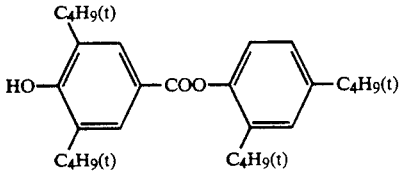
Cpd-4
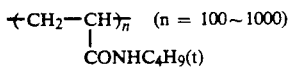
Cpd-5
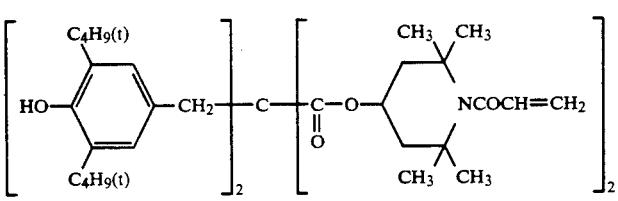
Cpd-6
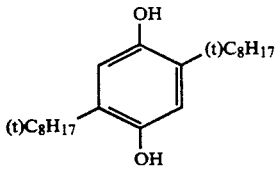
Cpd-7
Polyethylacrylate
Cpd-8
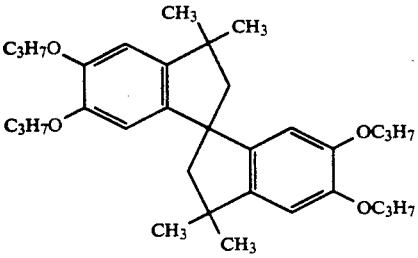
Cpd-9

-continued
Cpd-10
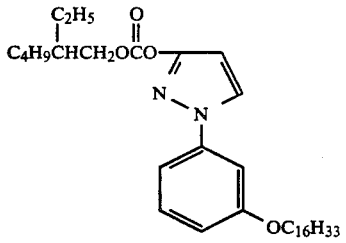
Cpd-11
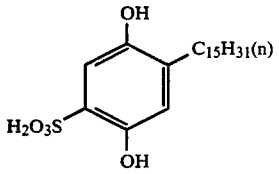
Cpd-12
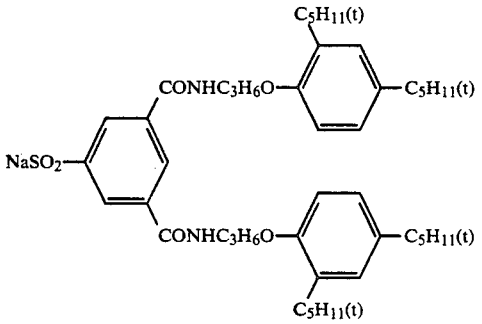
Cpd-13
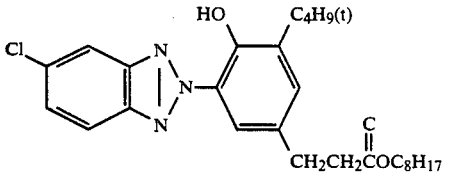
Cpd-14
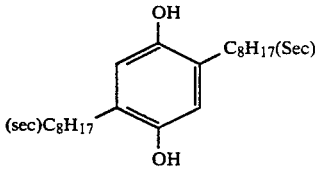
Cpd-15
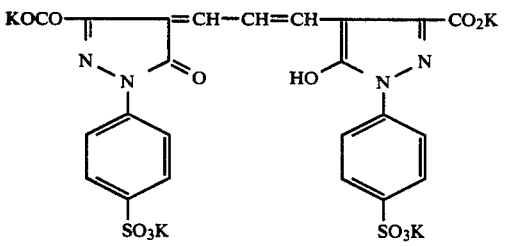
Cpd-16
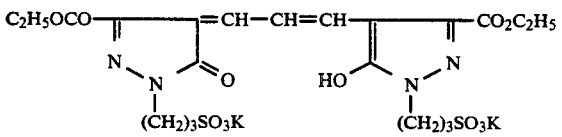

-continued
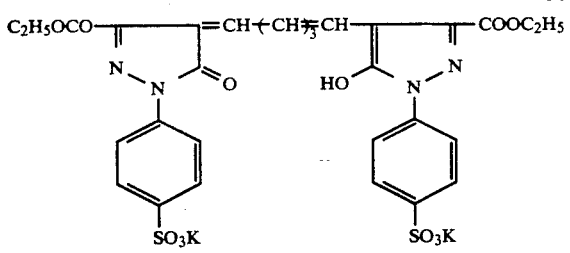
Cpd-17
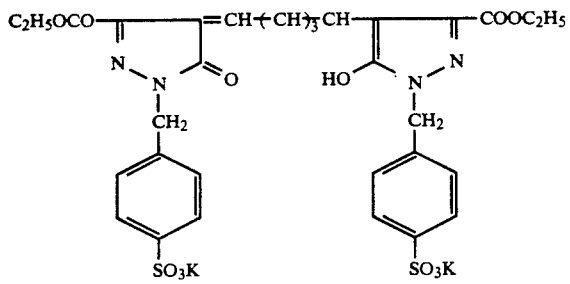
Cpd-18
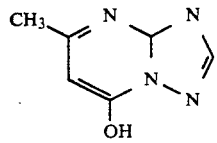
Cpd-19
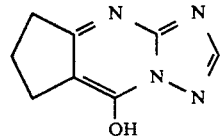
Cpd-20
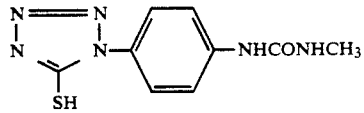
Cpd-21
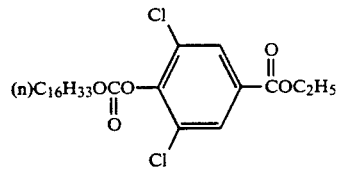
Cpd-22
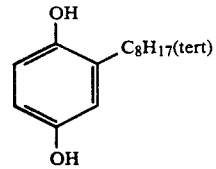
Cpd-23
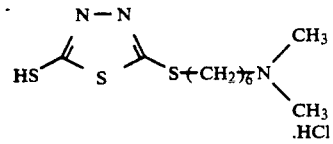
Cpd-24
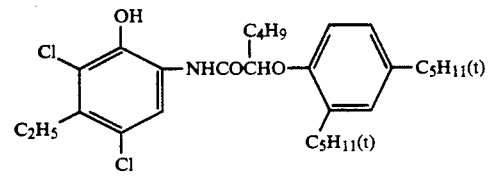
ExC-1

-continued

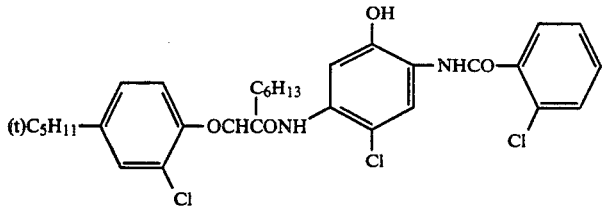

ExC-2

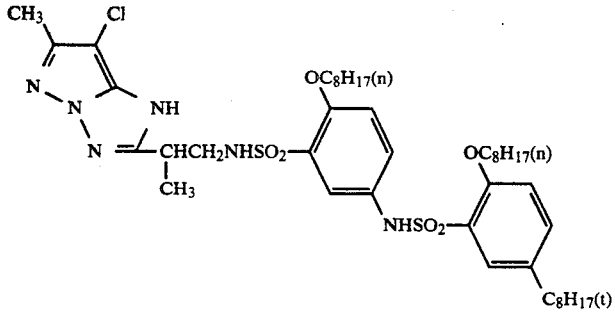

ExM-1

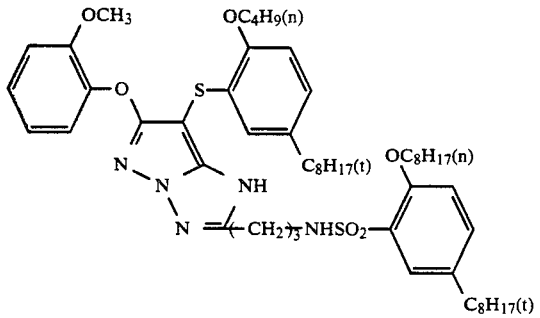

ExM-2

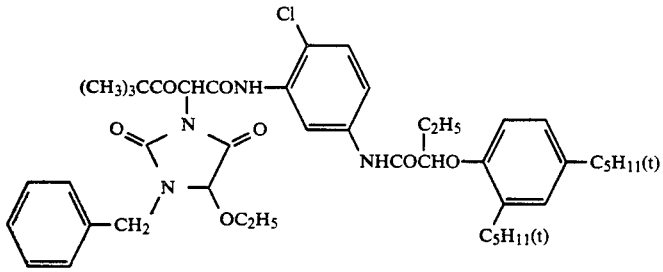

ExY-1

Solv-1: Di(2-ethylhexyl)phthalate
Solv-2: Trinonyl phosphate
Solv-3: Di(3-methylhexyl)phthalate
Solv-4: Tricresyl phosphate
Solv-5: Dibutyl phthalate
Solv-6: Trioctyl phosphate
Solv-7: Di(2-ethylhexyl)sebacate
H-1: 1,2-Bis(vinylsulfonylacetamido)ethane
ExZK-1: 7-[2-(5-mercaptotetrazol-1-yl)benzamido]-10-propargyl-1,2,3,4-tetrahydroacridinium perchlorate Each of the emulsions 2,4,5 and 10 was used in place of the emulsion 1 in the seventh layer to prepare each of samples 402 to 405.

These samples were subjected to wedge exposure (1/10 second, 300 CMS) and then processed in the same way as in Example 1.

The magenta color density of the resulting direct positive image was measured. The results are shown in Table 6.

TABLE 6

| Sample No. | Emulsion No. | Compound added | Dmax | Dmin |
|---|---|---|---|---|
| 401 (Comp. Ex.) | 1 | — | 1.80 | 0.22 |
| 402 (Invention) | 2 | I-1 | 2.10 | 0.15 |
| 403 (Invention) | 4 | I-8 | 2.12 | 0.14 |
| 404 (Invention) | 5 | I-12 | 2.15 | 0.14 |
| 405 (Invention) | 10 | I-25 | 2.15 | 0.15 |

It is apparent from Table 6 that the samples of the present invention had high Dmax and low Dmin.

EXAMPLE 5

The procedure of the preparation of the emulsion 1 was repeated except that the compounds given in Table 7 were added immediately after the core emulsion was obtained to prepare emulsions 52 to 57.

TABLE 7

| Emulsion No. | Compound | Amount added (mol/mol of Ag) |
|---|---|---|
| 1 | — | $2.5 \times 10^{-4}$ |
| 52 | 1 | " |
| 53 | 7 | " |
| 54 | 9 | " |
| 55 | 10 | " |
| 56 | 12 | " |
| 57 | 16 | " |

The procedure of the preparation of the sample 101 was repeated except that each of the emulsions 52 to 57 was used in place of the emulsion 1 to prepare each of samples 502 to 507.

These samples were subjected to exposure and development processing in the same way as in Example 1.

The cyan color density of the resulting direct positive image was measured. The results are shown in Table 8.

TABLE 8

| Sample No. | Emulsion No. | Compound added | Dmax | Dmin | Gamma |
|---|---|---|---|---|---|
| 101 (Comp. Ex.) | 1 | — | 1.80 | 0.30 | 1.4 |
| 502 (Invention) | 52 | 1 | 1.80 | 0.13 | 2.5 |
| 503 (Invention) | 53 | 7 | 1.82 | 0.14 | 2.4 |
| 504 (Invention) | 54 | 9 | 1.81 | 0.14 | 2.4 |
| 505 (Invention) | 55 | 10 | 1.80 | 0.15 | 2.4 |
| 506 (Invention) | 56 | 12 | 1.80 | 0.15 | 2.3 |
| 507 (Invention) | 57 | 16 | 1.79 | 0.16 | 2.3 |

In the samples 502 to 507 containing the compounds of the present invention, the minimum image density (Dmin) was low, while retaining the high maximum image density (Dmax). Further, the samples had large gamma values and are contrasty. Therefore, good results were obtained by using the compounds of the present invention.

EXAMPLE 6

The following emulsions 61 to 65 were prepared by changing the stage of the addition of the compound 1 in the preparation of the emulsion 52 as given in Table 9.

TABLE 9

| Emulsion No. | Stage of addition of compound 1 |
|---|---|
| 61 | During the formation of the core emulsion (when 75% of silver sulfate for core formation had been added) |
| 52 | Immediately after the formation of the core emulsion |
| 62 | After the completion of chemical sensitization of the core |
| 63 | During the formation of the shell (when 50% of silver nitrate for shell formation had been added) |
| 64 | Immediately after the formation of the shell |
| 65 | After the chemical sensitization of the shell |

The procedure of the preparation of the sample 101 was repeated except that each of the emulsions 61 to 65 was used in place of the emulsion 1 to prepare each of samples 661 to 665.

Further, after the coating solution for the first layer was prepared in the preparation of the sample 101, the compound 1 was added in such an amount to give a concentration of $2.5 \times 10^{-4}$ mol/mol of Ag, thus preparing a sample 671.

These samples were processed in the same way as in Example 1. The cyan color density of the resulting direct positive image was measured. The results are shown in Table 10.

TABLE 10

| Sample No. | Emulsion No. | Compound added | Dmax | Dmin | Gamma |
|---|---|---|---|---|---|
| 101 (Comp. Ex.) | 1 | — | 1.80 | 0.30 | 1.4 |
| 661 (Invention) | 61 | 1 | 1.80 | 0.14 | 2.5 |
| 502 (Invention) | 52 | " | 1.80 | 0.13 | 2.5 |
| 662 (Invention) | 62 | " | 1.75 | 0.14 | 2.4 |
| 663 (Invention) | 63 | " | 1.70 | 0.15 | 2.3 |
| 664 (Invention) | 64 | " | 1.60 | 0.15 | 2.3 |
| 665 (Invention) | 65 | " | 1.50 | 0.14 | 2.3 |
| 671 (Invention) | 1 | " | 1.50 | 0.19 | 2.0 |

It is apparent from Table 10 that the samples containing the compound of the present invention were superior to the comparative sample, in that gamma values were large, the images were contrasty and Dmin was low. As to when the compound is to be added, it is preferred to add the compound of the present invention during the formation of the emulsion and it is less preferred to add it after the preparation of the coating solution. It is most preferred to add it during the formation of the core or before chemical sensitization of the core.

EXAMPLE 7

A photographic material was prepared by using the emulsion 1 in the same way as in Example 1. The sample was referred to as sample 701.

The procedure of the preparation of the sample 701 was repeated except that each of the emulsions 52, 53 and 55 was used in place of the emulsion 1 to prepare each of samples 702 to 704.

These samples were subjected to exposure and development treatment in the same way as in Example 3.

The cyan color density of the resulting direct positive image was measured. The results are shown in Table 11.

TABLE 11

| Sample No. | Emulsion No. | Compound added | Dmax | Dmin | Gamma |
|---|---|---|---|---|---|
| 701 (Comp. Ex.) | 1 | — | 1.50 | 0.25 | 1.3 |
| 702 (Invention) | 52 | 1 | 1.50 | 0.10 | 2.4 |
| 703 (Invention) | 53 | 7 | 1.51 | 0.11 | 2.3 |
| 704 (Invention) | 55 | 10 | 1.50 | 0.12 | 2.3 |

It was found that the samples containing the compounds of the present invention provided good results wherein the image was contrasty and Dmin was low while retaining high Dmax.

EXAMPLE 8

A photographic material was prepared by using emulsion 1 in the same way as in Example 4. The resulting sample was referred to as sample No. 801.

Each of the emulsions 52, 53 and 55 was used in place of the emulsion 1 in the seventh layer to prepare each of samples 802 to 804.

These samples were subjected to exposure and development treatment in the same way as in Example 4.

The magenta color density of the resulting direct positive image was measured. The results are shown in Table 12.

TABLE 12

| Sample No. | Emulsion No. | Compound added | Dmax | Dmin | Gamma |
|---|---|---|---|---|---|
| 801 (Comp. Ex.) | 1 | — | 1.80 | 0.22 | 1.4 |
| 802 (Invention) | 52 | 1 | 1.80 | 0.10 | 2.5 |
| 803 (Invention) | 53 | 7 | 1.82 | 0.11 | 2.4 |
| 804 (Invention) | 55 | 10 | 1.80 | 0.12 | 2.3 |

It is apparent from Table 12 that the samples containing the compounds of the present invention provided contrasty image and had low Dmin while retaining high Dmax. Thus, good results were obtained using the compounds of the present invention.

These results demonstrate that when an image is formed using the direct positive photographic materials according to the present invention, direct positive images are obtained which have high maximum image density and low minimum image density, in which a suitable contrast range is obtained.

While the invention has been described in detail and with reference to specific embodiments thereof, it will be apparent to one skilled in the art that various changes and modifications can be made therein without departing from the spirit and scope thereof.

What is claimed is:

1. A process for preparing non-prefogged internal latent image core/shell silver halide grains which contain silver chlorobromide containing less than 50 mol% of chloride or silver bromide comprising: before forming the shell of the grains, adding at least one compound represented by formula (II), (III) and (IV)

$$Z_1-SO_2-S-M \quad \text{(II)}$$

$$Y_1 \quad C-SO_2-S-C \quad Y_2 \quad \text{(III)}$$

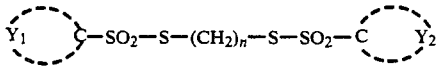

(IV)

wherein $Z_1$ represents an alkyl group containing from 1 to 18 carbon atoms, an aryl group containing from 6 to 18 carbon atoms or a heterocyclic group; $Y_1$ and $Y_2$, which may be the same or different, each represents an atomic group necessary for forming an aromatic ring containing from 6 to 18 carbon atoms, or a heterocyclic ring; M represents a metal atom or an organic cation; and n is an integer of 2 to 10.

2. The process as claimed in claim 1, wherein said internal latent image silver halide grains have a mean grain size of from 0.2 μm to 2.0 m.

3. The process for preparing internal latent image silver halide grains as claimed in claim 1, wherein the grains are present as a monodisperse silver halide emulsion.

4. The process for preparing internal latent image silver halide grains as claimed in claim 1, wherein the silver halide core grains are formed in the presence of at least one compound represented by formulae, (II), (III) and (IV).

5. The process for preparing internal latent image silver halide grains as claimed in claim 1, wherein the silver halide core grains are chemically sensitized in the presence of at least one compound represented by formulae (II), (III) and (IV).

6. The process for preparing internal latent image silver halide grains as claimed in claim 1, wherein the sliver halide grains are pure silver bromide.

7. The process for preparing internal latent image silver halide grains as claimed in claim 1, wherein the silver halide core grains are formed in the presence of a compound represented by formula (I):

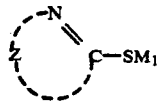

(I)

wherein $M_1$ represents hydrogen, a cation or a protective group capable of being cleaved by an alkali; and Z represents an atomic group necessary for forming a 5-membered or 6-membered substituted or unsubstituted ring selected from a heterocyclic ring and a condensed heterocyclic ring.

8. The process for preparing internal latent image silver halide grains as claimed in claim 7, wherein the compound represented by formula (I) is present in an amount of $10^{-6}$ to $10^{-2}$ mol per mol of said silver halide.

9. The process as claimed in claim 3, wherein said monodisperse silver halide emulsion has a coefficient of variation of at most 20.

10. The process as claimed in claim 7, wherein in formula (I) $M_1$ represents hydrogen, a cation or a protective group selected from —COR', —COOR' and —$CH_2CH_2COR'$, wherein R' represents hydrogen, an alkyl group, an aralkyl group or an aryl group and said substituted or unsubstituted ring formed by Z is selected from tetrazole, triazole, imidazole, oxazole, thiadiazole, pyridine, pyrimidine, triazine, azabenzimidazole, purine, tetraazaindene, triazaindene, benzotriazole, benzimidazole, benzoxazole, benzothiazole, benzoselenazole and naphthimidazole.

11. The process as claimed in claim 1, wherein said compound represented by formula (II), (III) or (IV) is present in an amount of $10^{-6}$ to $10^{-2}$ mol per mol of said silver halide contained in said internal latent image silver halide grains.

12. The process as claimed in claim 11, wherein said compound represented by formula (II), (III) or (IV) is present in an amount of $10^{-5}$ to $10^{-2}$ mol per mol of said silver halide contained in said internal latent image silver halide grains.

13. The process as claimed in claim 1, wherein in formulae (II), (III) and (IV) said heterocyclic ring formed by $Z_1$, $Y_1$ and $Y_2$ is selected from thiazole, benzothiazole, benzimidazole, oxazole, benzoxazole and azole.

* * * * *